United States Patent [19]

Leshner et al.

[11] Patent Number: 4,726,296

[45] Date of Patent: Feb. 23, 1988

[54] STRESS MODULATOR RING AND MICROGROOVED BASE FOR AN AMMUNITION CARTRIDGE HAVING A PLASTIC CASE

[75] Inventors: Ervin Leshner, Cherry Hill, N.J.; Reed E. Donnard, Huntingdon Valley, Pa.

[73] Assignee: Action Manufacturing Company, Philadelphia, Pa.

[21] Appl. No.: 725,405

[22] Filed: Apr. 22, 1985

[51] Int. Cl.[4] ..... F42B 5/30

[52] U.S. Cl. ..... 102/467; 102/430; 102/469

[58] Field of Search ..... 102/464–468, 102/430, 444, 469, 470, 472

[56] References Cited

U.S. PATENT DOCUMENTS

| | | | |
|---|---|---|---|
| 3,099,958 | 8/1963 | Daubenspeck et al. | 102/467 X |
| 3,242,789 | 3/1966 | Woodring | 102/467 X |
| 3,370,534 | 2/1968 | Herter | 102/466 |
| 3,842,739 | 10/1974 | Scanlon et al. | 102/467 |
| 3,955,506 | 3/1976 | Luther et al. | 102/467 |

FOREIGN PATENT DOCUMENTS

| | | | |
|---|---|---|---|
| 747660 | 8/1970 | Belgium . | |
| 1905103 | 8/1970 | Fed. Rep. of Germany . | |
| 861071 | 1/1941 | France . | |
| 1420080 | 10/1965 | France | 102/467 |
| 2141742 | 1/1973 | France . | |
| 238162 | 10/1945 | Switzerland | 102/467 |
| 458996 | 8/1968 | Switzerland . | |
| 988596 | 4/1965 | United Kingdom . | |
| 1175305 | 12/1969 | United Kingdom . | |

*Primary Examiner*—Harold J. Tudor

*Attorney, Agent, or Firm*—Woodcock Washburn Kurtz Mackiewicz & Norris

[57] ABSTRACT

An ammunition cartridge has a plastic case and a metal base having a plurality of grooves around the periphery thereof. The plastic case has an interference fit with the base. The plastic creeps into the grooves after being interference fit over the base to relieve the stress in the plastic. A stress modulator ring surrounds the plastic member in the area of the grooves.

17 Claims, 10 Drawing Figures

STRESS MODULATOR RING AND MICROGROOVED BASE FOR AN AMMUNITION CARTRIDGE HAVING A PLASTIC CASE

BACKGROUND OF THE INVENTION

This invention relates to an an ammunition cartridge assembly of a separate metal or plastic case head.

The use of plastic cases for explosive rounds has long been recognized as being desirable. U.S. Pat. Nos. 4,147,107—Ringdal and 3,842,739—Scanlon, et al show plastic cartridge cases. Joining the plastic case to a metal base has been a severe problem. A tight seal is necessary, and this is accomplished by stretching the plastic case over the metal base in an interference fit. This interference fit stresses the plastic. Eventually, splitting of the plastic occurs, particularly where the round has a long shelf life.

It is an object of the present invention to provide a unique ammunition cartridge having a plastic case with significantly reduced stress cracking and creep.

It is another object of the present invention to provide a unique multicomponent, plastic-cased ammunition cartridge possessing a high order of mechanical integrity of the component assembly and excellent waterproofness.

SUMMARY OF THE INVENTION

In accordance with the present invention, a cartridge assembly has a separate metal or plastic case head, a plastic case body, and a stress modulator ring. The case head has microgrooves located on its surface which interface with the plastic case body. By action of a stress modulator ring that applies an initial temporary compressive force, plastic material in the case body interfacing the microgrooves on the case head surface is caused to flow into the free volume of the microgrooves. The microgroove volume is such that a somewhat greater microgroove volume is available than the volume of plastic material of the case body caused to flow by action of the stress modulator ring. At the conclusion of this process, the assembly is stress-free, waterproof, and permanently joined.

The components are permanently assembled in a stress free state by the action of the stress modulator ring that causes immediate flow of plastic case body material into the free volume of the microgrooves during the assembly process. The very nature of case body plastic cold flow into the microgrooves is the stress relieving process which also creates an extremely high order of mechanical integrity.

The stress modulator ring is positioned around the outside of the base case body interface and is swaged into the taper line of the cartridge, thus causing flow of the plastic case body material. The flow is equivalent to the force generated from the small initial interference fit and the instantaneous (but not lasting) compressive force of the swaged stress modulator ring into the free microgroove volume. The stress modulator ring neutralizes the initial small tensile hoop stress of plastic body due to the interference fit by transferring that volume of the plastic case body plus case body material transported into the microgrooves resulting from the compressive swaging action. The plastic case body material in the microgrooves is neutrally stressed with respect to tension or compression since excess microgroove volume is available compared to the volume of plastic case body displaced into the microgrooves.

In an exemplary embodiment of the invention, the round is a 50 caliber live or blank cartridge. In other exemplary embodiments, the round is an impulse cartridge and a detonator.

The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
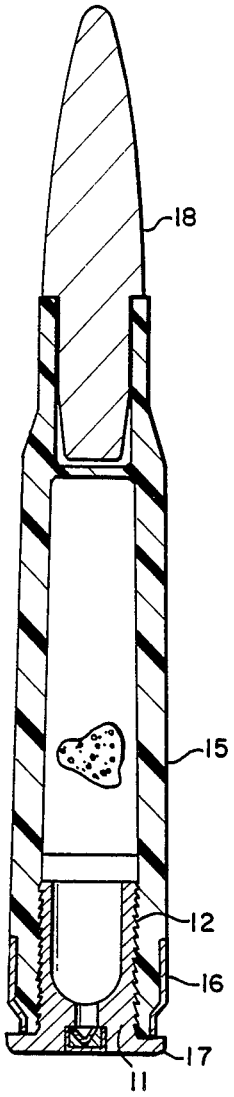
FIG. 1 shows the invention embodied in an ammunition cartridge.
Figure 1A:
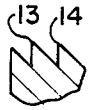
FIG. 1A shows the microgrooves in more detail.
Figure 1B:
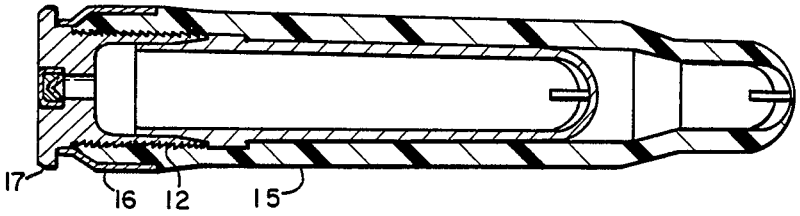
FIG. 1B shows an exemplary 0.50 caliber plastic blank cartridge assembly.

In FIGS. 1A and 1B, a metal base 11 for a 0.50 caliber cartridge, has a plurality of microgrooves 12 around the periphery. The buttress grooves are better shown in FIG. 1A. They include immediately adjacent grooves with buttress points 13 and 14 defining the intervening groove. One wall of the groove extends perpendicularly from the buttress point and the other wall slopes in the direction of motion between the base 11 and the plastic member 15 during assembly.

Microgrooves of the present invention are very small, about 0.010" deep, sharply pointed grooves with sides which are straight and meet with no space at the bottom of the groove. This is as opposed to ridges with intervening flat bottom grooves, such as shown in the aforementioned Ringdal patent, which are used for holding a cartridge case onto the base. The purpose of the microgrooves of the present invention is to induce the cold flow of plastic which quickly relieves the initial compressive force applied when a stress modulator ring 16 is swaged onto the case. The assembly is then stress free. On the other hand, the large spaces between the ridges in the Ringdal patent preclude the possibility of easily forcing the plastic of the outer case body into these large grooves. The large beadings or ridges in Ringdal must fit into grooves molded into the plastic case outer body. A tight fit causes the plasti case outer body to be constantly stressed in hoop tension, whereas the microgrooves of the present invention relieve the stress in the plastic.

In FIGS. 1A and 1B, the plastic member 15 is a cylindrical cartridge case. After assembly, the plastic of case 15 creeps into the grooves to relieve stress in the plastic caused by swaging the stress modulator ring 16 onto the case.

Metal stress modulator ring 16 surrounds the plastic case 15 in the area of the grooves 12. During assembly, force is applied to the ring 16 to swag the cartridge case onto the base.

Base 11 has an extractor rim 17. The stress modulator ring 16 extends from the extractor rim 17 to form an ejection groove around the periphery of the end of the round.

Plastic cartridge case 15 contains a propellant. In FIG. 1, a bullet 18 is lodged in the opposite end of the cartridge case from the metal base 11.

Figure 2:
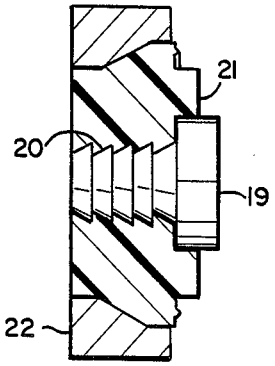
FIG. 2 shows the invention embodied in an impulse cartridge pin contact assembly.

FIG. 2 shows the invention embodied in an impulse cartridge pin contact assembly. The metal base is a pin 19 which has microgrooves 20 around the periphery thereof to relieve stress in the plastic member 21. A metal retaining ring 22 surrounds the plastic member 21. During assembly, the pin 19 is forced into the plastic member to expand it, thereby forming a good seal with the retainer ring 22. After this, the plastic flows into the grooves 20 to relieve the stress in the plastic. In the pin contact assembly of FIG. 2, a bridge wire connects retaining ring 22, which is normally at ground potential, and pin 19 to which a voltage is applied for detonation. Good hermetic sealing is required and this is achieved by the metal to plastic seal which can be obtained in accordance with the present invention without being subject to stress which might otherwise eventually crack the plastic and destroy the hermetic seal.

Figure 3:
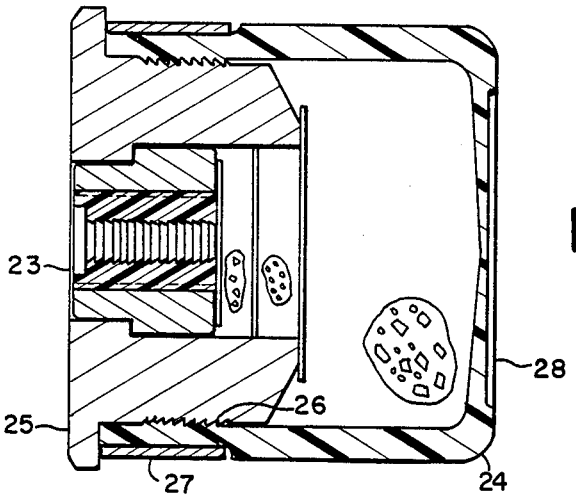
FIG. 3 shows the invention embodied in an impulse cartridge.

FIG. 3 shows an impulse cartridge with two applications of the present invention. The impulse cartridge has a pin contact assembly 23 with a pin having microgrooves similar to that just described with reference to FIG. 2. The impulse cartridge has a plastic case 24 with an interference fit to the metal base 25. Microgrooves 26 in the metal base 25 relieve the stress in the plastic after the interference fit is formed. A metal modulator ring 27 surrounds the plastic in the area of the grooves. The ring 27 is compressed to form the interference fit.

Figure 4:
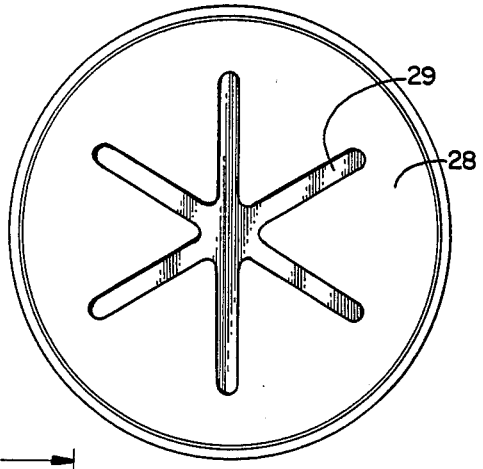
FIG. 4 is a view of the closed end of the impulse cartridge of FIG. 3.

The cartridge case 24 has an open end into which the base 25 is inserted and a closed end 28. As best shown in FIG. 4, the closed end 28 has weakened portions 29 which split upon explosion to produce an impulse from the closed end. The impulse cartridge is used in applications such as aircraft ejection seats where an explosive impulse is required.

Figure 5:
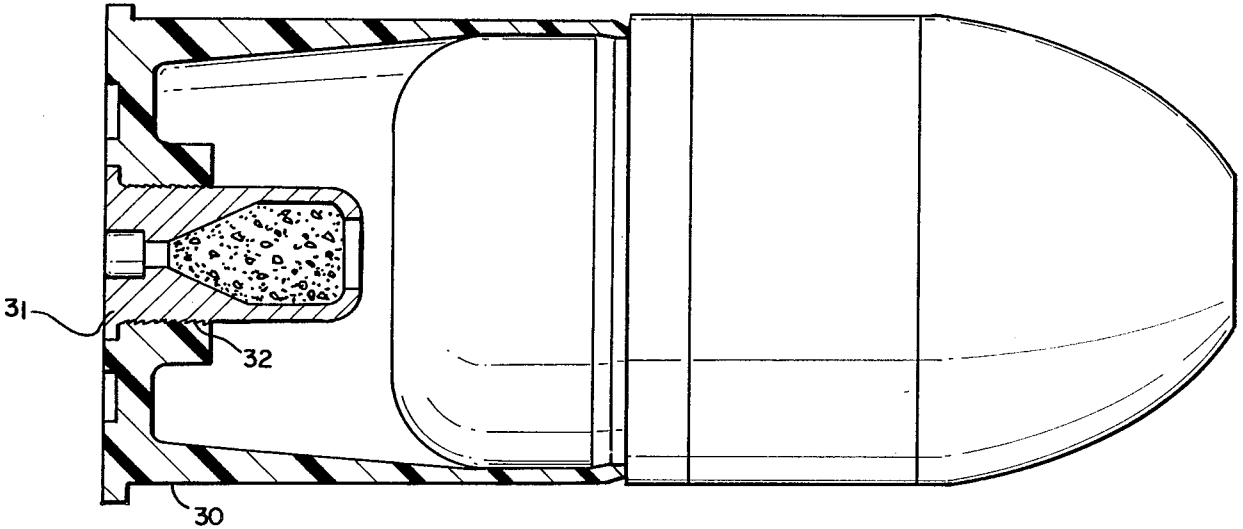
FIG. 5 shows the invention embodied in a 40 mm practice cartridge.

FIG. 5 shows the application of the invention to a 40 mm practice cartridge. In this case, the plastic member 30 has a central opening for insertion of the metal base 31 which has microgrooves at 32. The metal base is forced into the plastic member to form the interference fit between them without the need for a stress modulator ring.

Tests showing the improved performance achieved by the invention were performed on a 50 caliber round of the type shown in FIG. 1B. The assembly and testing of such a round is described below.

During the final assembly state of the blank cartridge, the primed case head was inserted into the open end of the plastic blank body component. The stress modulator ring was placed on the plastic case body previous to this final assembly operation. At this point, the plastic case wall reposed in a state of mild compression between the stress modulator ring and the case head insert due to a small interference fit between the components. A nominal interference of 0.002" to 0.005" is applicable.

The assembled cartridge was pushed into a split ring swaging die. This action compressed the stress modulator ring into the normal taper line of the cartridges. An initial compressive force was established in the plastic around the microgrooves on the case head. This compressive force was relieved readily as the plastic flowed or crept into the free volume of the microgrooves.

Figure 6:
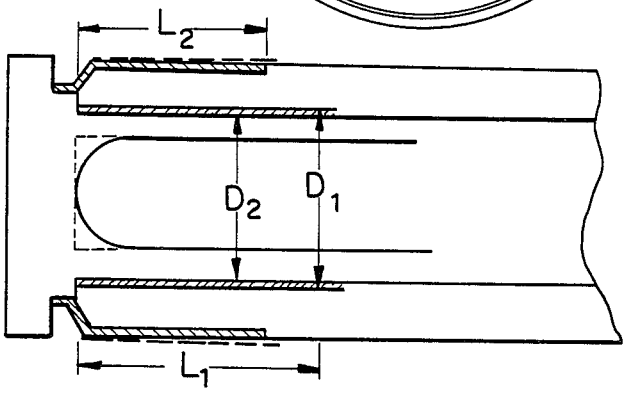
FIG. 6 depicts the dimensions of an exemplary 50 mm cartridge upon which experimental results were based.

FIG. 6 provides dimensional references and a basis for the degree of microgroove free volume fill by the plastic for the optimum microgroove configuration.

The microgroove free volume is equal to ½ the total volume between the solids generated by the two diameters.

$$V_{FREE} = \frac{\pi D_1^2 L_1}{4} - \frac{\pi D_2^2 L_1}{4} /2 = .0069 \text{ in.}^3$$

For a minimum interference of 0.002" between the case head insert and the plastic case I.D., the microgroove volume filled by the initial interference fit is as follows.

$$V = \frac{\pi L_1}{4}(D_1^2 - D_2^2) = \frac{\pi(.690)}{4}[(.592)^2 - (.590)^2] = .00128 \text{ in.}^3$$

For a maximum interference of 0.005" between case head insert and plastic case I.D. the volume is:

$$V = \frac{\pi L_1}{4}(D_1^2 - D_2^2) = \frac{\pi(.690)}{4}[(.592)^2 - (.587)^2] = .00319 \text{ in.}^3$$

The decrease in diameter caused by swaging of the stress modulator ring produces an increasing diameter decrease in accordance with the taper line of the cartridge. An estimate of the plastic material squeezed into the microgrooves, after the initial compression, can be made by using the average diameter decrease of the stress modulator ring (S.M.R.). Even though the S.M.R. is slightly shorter than the microgroove length, plastic material along the entire microgroove length will be influenced by the S.M.R. swaging operation.

The total volume of plastic displaced by swaging is then:

$$V = \frac{\pi L_1}{4}(D_1^2 - D_2^2) \text{ where } D_1 = .592'' \text{ and } D_2 = .587''$$

$$V = \frac{\pi(.690)}{4}[(.592)^2 - (.587)^2] = .00319 \text{ in.}^3$$

The percentage of microgroove volume filled (minimum interference of 0.002" plus S.M.R.) is:

| | |
|---|---|
| Microgroove volume fill due to minimum interference | .00128 in$^3$ |
| Microgroove volume fill due to S.M.R. | .00319 |
| TOTAL | .00447 in$^3$ |

$$\text{Percentage of microgroove fill} = \frac{(.00447)(100)}{.0069} = 64.8\%$$

The percentage of microgroove volume filled (Maximum interference of 0.005" plus S.M.R.) is:

| | |
|---|---|
| Microgroove fill due to maximum interference | .00319 in$^3$ |
| Microgroove fill due to S.M.R | .00319 in$^3$ |
| TOTAL | .00638 in$^3$ |

-continued $$\text{Percentage of microgroove fill} = \frac{(.00638)(100)}{.0069} = 92.5\%$$

Thus it can be seen that the microgroove volume available on the case head is capable of absorbing the interference plastic volume created by the initial interference between the case head insert and the internal diameter of the plastic case body. This optimum microgroove volume is able to accommodate also the plastic volume which results from the swaging of the S.M.R. The initial compression stresses created by the above actions are relieved as the plastic is made to flow into the microgrooves.

swaging operation. This was discussed previously and illustrated in FIG. 7. In essence, the average reduction in diameter of the stress modulator ring is approximately 0.0056". Also, adding a nominal interference fit between the case head and the plastic case body of 0.003", the total compression effect is equivalent to 0.0086".

With these two boundarv conditions, a series of analytical calculations were made using the design equation. In order to generate a realistic compression factor for the S term, a compression deflection curver for H.D. polyethylene was made using a loading punch having an area similar to that of the stress modulator ring in contact with the plastic case material. This curve is shown in FIG. 6. The design data is summarized in Table 1.

TABLE 1

| | 16 BUTTRESS GROOVE POINTS/INCH | | | | 32 BUTTRESS GROOVE POINTS/INCH | | | | 50 BUTTRESS GROOVE POINTS/INCH | | | |
|---|---|---|---|---|---|---|---|---|---|---|---|---|
| F LBS. | DE-GREES | PITCH INCH | S.M.R COMP. REQ. INCH | INI-TIAL COMP. STRESS PSI* | DE-GREES | PITCH INCH | S.M.R COMP. REQ. INCH | INI-TIAL COMP. STRESS PSI* | DE-GREES | PITCH INCH | S.M.R COMP. REQ. INCH | INI-TIAL COMP. STRESS PSI* |
| 950 | 80.98 | .063 | .0115 | 1638 | 72.12 | .031 | .009 | 1176 | 63.44 | .020 | .0077 | 934 |
| 1000 | 80.98 | .063 | .0119 | 1724 | 72.12 | .031 | .0093 | 1238 | 63.44 | .020 | .0079 | 983 |
| 1050 | 80.98 | .063 | .0124 | 1810 | 72.12 | .031 | .0097 | 1300 | 63.44 | .020 | .0082 | 1032 |

*THIS INITIAL COMPRESSION STRESS IS, BY DESIGN, RELIEVED BY COLD FLOW INTO THE MICROGROOVES.

A characterization of optimum microgroove parameters is given by:

$$F = 25.1\ N1.5\ S\ P^2 \cot \alpha$$

where

F=Force in pounds required to withdraw the case head from the plastic case body after swaging of the stress modulator ring.

N=Number of buttress microgroove points on the case head insert in contact with the plastic case body.

S=Initial compression stress in pounds per square inch exerted on the plastic case body by swaging the stress modulator ring and initial interference fit.

P=Pitch of buttress microgroove.

$\alpha$=Peak angle of buttress microgroove in contact with plastic case body.

The appropriate constant of proportionality was identified by use of experimental data.

By use of this design equation it is possible to study the effect of the pertinent variables on the ability to firmly hold the case head in the plastic case body during firing of the blank cartridge. In order to use this equation effectively, one must know what boundary conditions pertain to the 0.50 caliber plastic blank cartridge. Two conditions are essential to this cartridge design.

The first concerns the mechanical integrity of the case head/plastic body interlock. It was determined experimentally that this interlock or mechanical joint became stronger than the plastic material in the case lower body sidewall when the force to extract the case head from the body registered approximately 1050 pounds. It is essential that this condition of the case head/case body permanence be achieved for satisfactory cartridge performance in the automatic weapon. Our experimental observations revealed that this condition could be attained for various combinations of all of the factors cited in the above design equation.

Figure 7:
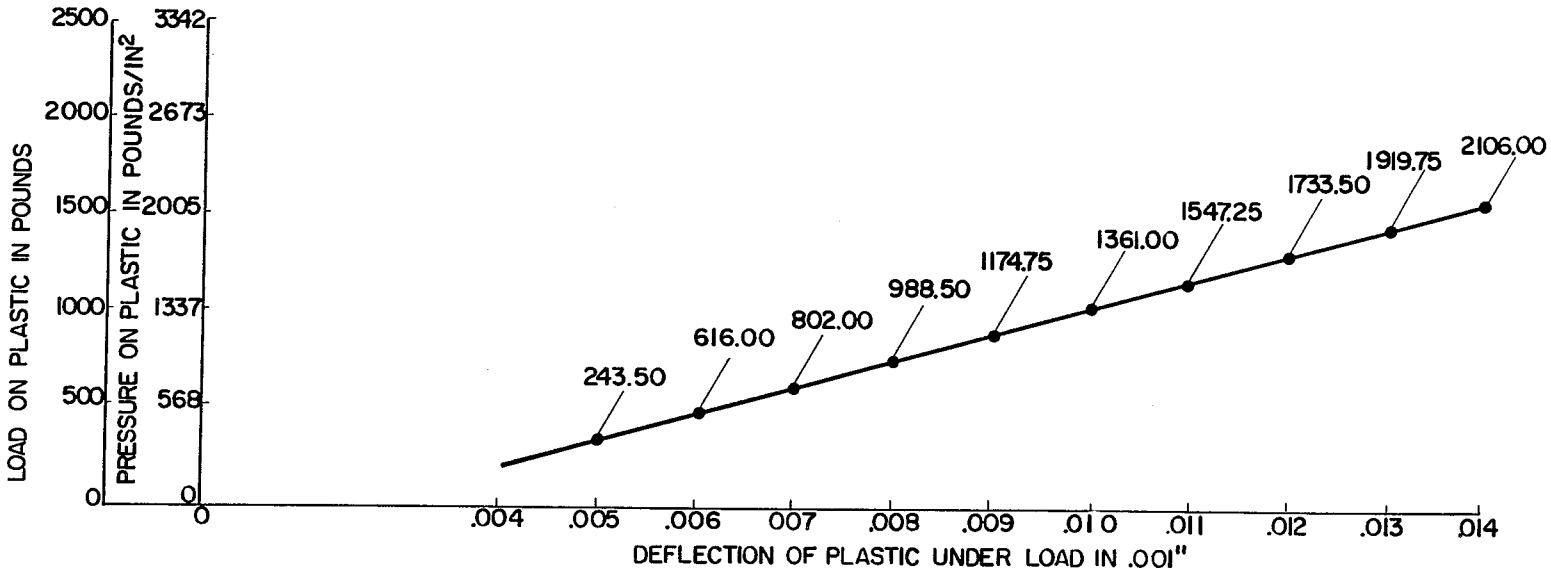
FIGS. 7 and 8 are curves representing the experimental results.
Figure 8:
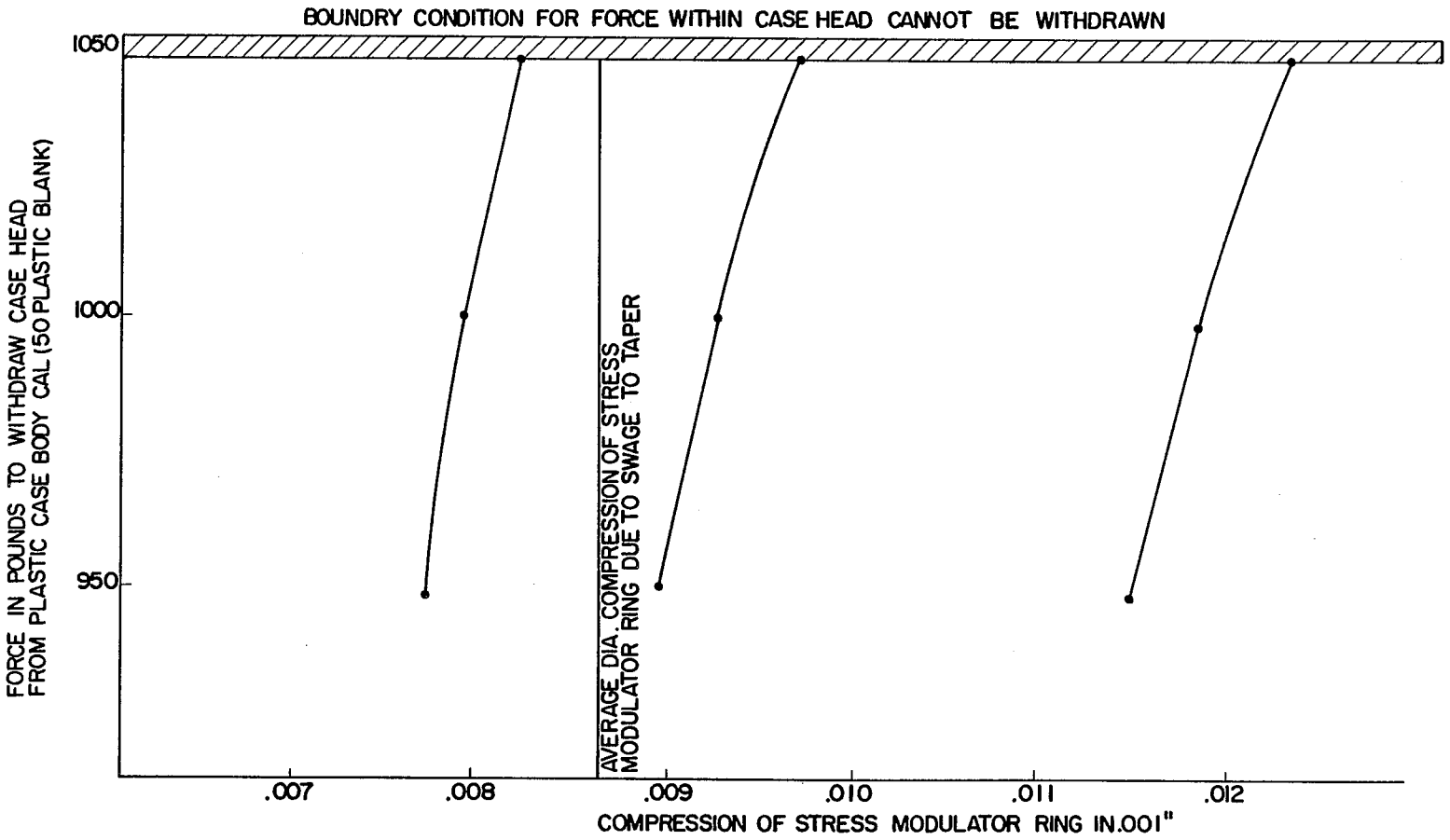

The second boundary condition concerns the degree of initial compression available during the assembly FIG. 7 represents the design curves showing the effect of number of microgrooves per inch and the degree of stress modulator ring compression required for the desired function. It can be seen that the magnitude of stress modulator ring compression requirement is less as the buttress microgroove points per inch is increased. The control boundary conditions are satisfied when 50 buttress microgroove points/inch are used and the appropriate initial interference fit is combined with the swaging compression on the stress modulator ring. A 50 buttress groove points/inch configuration is optimum for the 0.50 caliber plastic blank cartridge design based on the above analysis.

While a particular embodiment of the invention has been shown and described, various modifications are within the true spirit and scope of the invention. The appended claims are, therefore, intended to cover all such modifications.

What is claimed is:

1. An ammunition cartridge comprising:

(a) a cylindrical base having a plurality of grooves around the periphery thereof;

(b) a cylindrical plastic member having a portion thereof disposed around said grooves in said base; and (c) a stress ring surrounding said plastic member in the area of said grooves to modulate the stress in said plastic, said grooves comprising means for relieving substantially all of the plastic member stress produced by said stress ring, whereby said plastic member is a stress relieved plastic member.

2. The ammunition cartridge recited in claim 1 wherein said stress ring comprises a metal stress ring.

3. The ammunition cartridge recited in claim 2 wherein said base is metal and has an end cap, said ring extending from said end cap.

4. The ammunition cartridge recited in claim 3 wherein said ring and said end cap form an ejection groove around the periphery of the end of said round.

5. The ammunition cartridge recited in claim 1 wherein said plastic member is a hollow cartridge case which contains an explosive.

6. The ammunition cartridge recited in claim 5 further comprising:

a bullet lodged in the opposite end of said cartridge case from said metal base.

7. The ammunition cartridge recited in claim 5 wherein said ammunition cartridge is an impulse cartridge and wherein said case has a closed end and an open end into which said base is inserted, said case including an explosive, said closed end having weakened portions which split upon explosion to produce an impulse from said closed end.

8. The ammunition cartridge recited in claim 1 wherein said base is a pin contact for the detonator of said round and said plastic member is an insulator which surrounds said pin contact.

9. The ammunition cartridge recited in claim 1 wherein said grooves are buttressed grooves.

10. The ammunition cartridge recited in claim 9 wherein said grooves are separated by buttress points, one side of said groove extending perpendicularly from the buttress point toward the axis of the cylindrical base, the other side of said groove extending at an angle away from the buttress point.

11. The ammunition cartridge recited in claim 10 wherein the number of buttress points is approximately 50 points per inch.

12. The amunition cartridge recited in claim 1 wherein said grooves are separated by sharp points and wherein the sides of said groove are straight, and meet without space between them at the bottom of each groove.

13. The ammunition cartridge recited in claim 2 wherein said stress modulator ring is swaged into the taper line of the cartridge, thereby causing flow of the plastic case body material into said microgrooves.

14. The ammunition cartridge recited in claim 13 wherein the flow of plastic is equivalent to the force generated from the initial interference fit and the instantaneous compressive force of the swaged stress modulator ring.

15. An ammunition cartridge of the type having a base and a plastic member attached to the base comprising:

(a) a cylindrical base having a plurality of grooves around the periphery thereof, said grooves being separated by sharp points for inducing the cold flow of plastic;

(b) a cylindrical plastic member having a portion thereof disposed around said grooves; and (c) stress ring means surrounding said plastic member in the area of said grooves for providing an initial compressive force to said plastic member, said initial compressive force and said points inducing the cold flow of plastic member material into said grooves, said grooves providing a free volume sufficient to contain said plastic member material so induced to cold flow, whereby said plastic member is a substantially stress free plastic member.

16. The ammunition cartridge of claim 15 wherein said stress ring means is a metal stress ring.

17. The ammunition cartridge of claim 16 wherein said stress ring is swaged into the taper line of the cartridge.

* * * * *